73-651 SR
1/9/79 XR 4,133,207

United States Patent [19]
Weidmann et al.
[11] 4,133,207
[45] Jan. 9, 1979

[54] DEVICE FOR DETECTING KNOT-LIKE THICK PLACES IN TRAVELLING TEXTILE THREADS

[75] Inventors: Erich Weidmann, Wetzikon; Hans Zollinger, Grüt, both of Switzerland

[73] Assignee: Gebruder Loepfe AG, Wetzikon, Switzerland

[21] Appl. No.: 826,971

[22] Filed: Aug. 22, 1977

[30] Foreign Application Priority Data

Oct. 13, 1976 [CH] Switzerland ..... 12922/76

[51] Int. Cl.² ..... G01N 19/08

[52] U.S. Cl. ..... 73/160; 73/651; 340/677; 340/683

[58] Field of Search ..... 73/160, 1 DV, 651, 88.5 R, 73/88.5 SD; 57/81; 340/259, 261

[56] References Cited

U.S. PATENT DOCUMENTS

| | | | |
|---|---|---|---|
| T886,007 | 5/1971 | Harvey | 73/88.5 R |
| 2,506,174 | 5/1950 | Price | 57/81 |
| 2,524,579 | 10/1950 | Taylor | 57/81 |
| 3,611,342 | 10/1971 | Raaben | 340/259 |
| 4,060,965 | 12/1977 | Schwartz | 73/160 |

*Primary Examiner*—S. Clement Swisher
*Assistant Examiner*—Denis E. Corr
*Attorney, Agent, or Firm*—Werner W. Kleeman

[57] ABSTRACT

Novel device for detecting knot-like thick places in travelling textile threads, comprising a plate-shaped or rectangular vibratory member which is fixed at one end and has a straight edge at its other end. A plate-shaped piezoelectrical transducer element is fixed at one of the major surfaces of said vibratory member. A thread guiding member having a straight edge is arranged in essentially parallel relationship to the straight edge of the vibratory member such as to form a thread passage gap between said straight edges. Means adjust the width of said thread passage gap, and a case or support structure is provided for receiving the vibratory member, electromechanical transducer element and thread guiding member.

2 Claims, 3 Drawing Figures

DEVICE FOR DETECTING KNOT-LIKE THICK PLACES IN TRAVELLING TEXTILE THREADS

BACKGROUND OF THE INVENTION

The present invention relates to a new and improved construction of a device for detecting knot-like thick places in travelling textile threads or the like. It is known to use capacitive or optoelectrical transducers for detecting thick places in textile threads travelling at textile machines or through a testing device, and to process the electrical signals generated by the transducers in an electronic circuitry which produces output signals indicative of the presence of such thick places.

Moreover, from German patent No. 1,101,018 there is known a mechanoelectrical device for detecting thick places and knots in threads or rovings and twisted yarns, where the thread material to be tested travels through a slot of a guage which is set to the nominal thickness value of the thread material, and where an electrical contact system is actuated, by means of resilient feeler members, when said nominal thickness value is exceeded, causing the thread travel to be stopped and/or a counting device to be tripped.

Capacitive or optoelectrical transducers or sensing devices which operate without touching the thread work accurately and without inertia even at high yarn speeds, however, they are expensive to manufacture. On the other hand, mechanoelectrical sensing devices exhibit a certain amount of sluggishness or inertia owing to the relatively great mass of the feeler member touching the thread. Thus, such mechanoelectrical sensing devices do not work in a satisfactory manner at high yarn travel speeds.

SUMMARY OF THE INVENTION

It is a primary object of the invention to provide a mechanoelectrical sensing device for detecting knot-like thick places in travelling yarns which has low inertia and operates accurately even at high yarn speeds.

It is a further objective of the invention to supply a sensing device which is simple and may be manufactured with low expenditure.

These and other objects will be apparent as the description proceeds may be realized by the inventive sensing or detecting device comprising a support structure, a vibratable plate-shaped or cantilever member whose free end is formed with a first straight edge, a mechanoelectrical transducer element supported by said cantilever member and responsive to vibration thereof, a thread guide member having a second straight edge arranged in opposite relationship to said first straight edge, such that a thread passage gap is formed between said first and second straight edges, and means for adjusting the width of said thread passage gap.

BRIEF DESCRIPTION OF THE DRAWINGS

The invention will be better understood upon consideration of the following detailed description thereof which makes reference to the annexed drawings wherein.

DETAILED DESCRIPTION OF THE INVENTION

Figure 1:
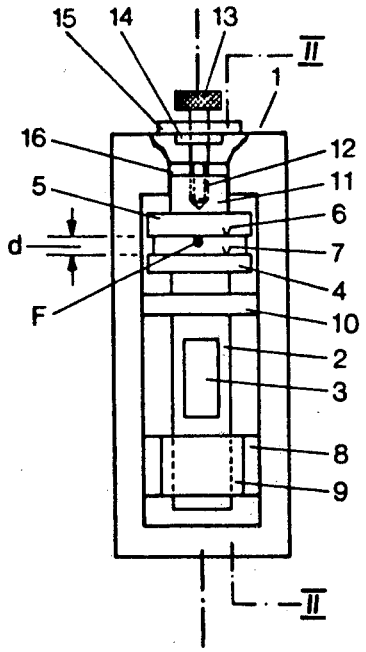
FIG. 1 shows an embodiment of the inventive sensing or detecting device, with lid removed, in front view.
Figure 2:
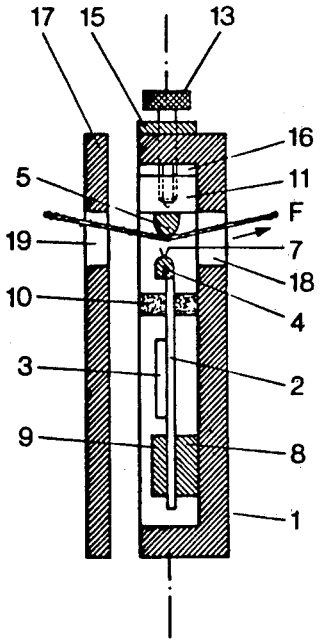
FIG. 2 is a cross-sectional view of the device shown in FIG. 1, including the lid, taken along the line II—II in FIG. 1.

With reference to FIGS. 1 and 2, a casing 1 which serves as a support structure for the other components of the sensing device is designed as an oblong rectangular receptacle. A substantially rectangular resilient tongue or cantilever member 2 is clamped at one of its ends in a bearing block 8, by means of a cover plate 9. The other free end 4 of tongue 2 is bent over such as to form a rounded first straight edge 7. Free end 4 is laterally extended over both of the longitudinal edges of tongue 2, as shown in FIG. 1. Beneath free end 4, there is arranged in casing 1 a damping material 10 which embraces tongue 2 and at the same time prevents dust and dirt from penetrating into the lower part of casing 1. The damping material 10 preferably consists of porous soft elastic material, such as foam or sponge rubber. At one of the major faces of tongue 2 between bearing block 8 and damping material 10, there is attached a rectangular plate-shaped piezoelectrical transducer element 3, e.g. by soldering or cementing.

The electrodes and electrical connections of transducer element 3 which are not shown may be formed in conventional manner.

In the upper part of casing 1 there is placed a rod-shaped thread guide 5 of semicircular cross-section, forming a second straight edge 6 which is arranged in parallel and opposite relationship to the first straight edge 7 of resilient tongue 2 such as to form a thread passage gap between said straight edges 6, 7. Thread guide 5 is made of a hard material, such as ceramic oxide. Thread guide 5 is mounted in casing 1 movable in the longitudinal dimension of tongue 2, so that the distance d or width of the gap between the first and second straight edges 6 and 7, respectively, may be changed continually. For this purpose, thread guide 5 is fixed to a block-shaped slide member or slider 11 provided with an internal thread 12. A set screw 13 whose non-referenced shank passes through an equally non-referenced bore in the upper wall of casing 1 engages with the internal thread 12 of slider 11. At the shank of set screw 13 there is fixed a collar 14 sunk into the upper wall of casing 1 and covered by a counter flange 15 fixed to the outer face of casing 1, in such a manner that set screw 13 is prevented from axial displacement. Slider 11 is slidably guided in a recess 16 of casing 1 such as to be secured against rotational motion.

The open side of casing 1 is covered by a plate-shaped cover plate 17 which may be fixed to casing 1 by screws (not shown) or equivalent fastening means. As may be seen in particular from FIG. 2, there are provided, on both sides of the gap between the first and second straight edges 6 and 7, respectively, a first window 18 in the bottom of casing 1, and a second window 19 in lid 17 in covering relationship with first window 18. The width of the windows 18, 19 in the longitudinal direction of casing 1 may be dimensioned such that a thread F can be guided over thread guide 5 at an obtuse angle without contacting the edges of windows 18, 19 as shown in FIG. 2. Alternatively, guide members (not shown) made of ceramic oxide may be used and inserted in windows 18, 19, which, in this event, as well as the guide members, should be shaped circular.

Tongue 2 is preferably made of a thin resilient material, such as steel, bronze or brass, in order to present as little inertia as possible when tongue 2 is deflected by a knot appearing in the travelling thread. By way of example, the mechanical vibratory system comprising tongue 2 and transducer element 3 may have a fundamental frequency far below 100 Hz when the thickness of tongue 2 is about 0.1 mm and the free length thereof is 20 mm. However, with the applications which will still be described, it is also possible to make use of the overtone vibrations of said vibratory system.

Figure 3:
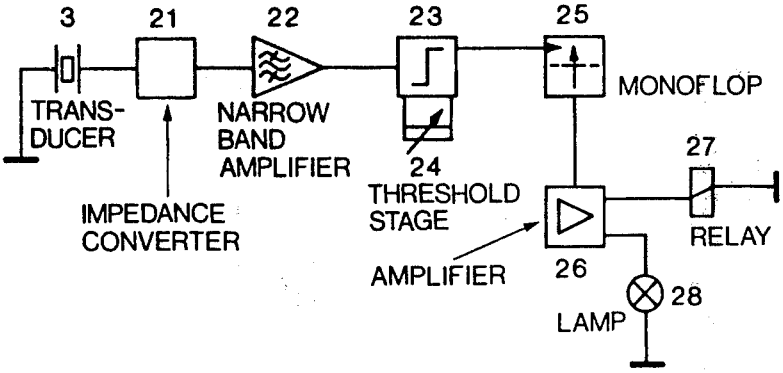
FIG. 3 is a schematic representation of the electronic circuitry associated with the sensing device shown in FIGS. 1 and 2.

FIG. 3 shows an electronic circuitry 21–26 adapted for evaluating the output signal of the sensing device illustrated by FIGS. 1 and 2, when such sensing device is used on textile machines which produce spurious noise or sound conducted through solids, and for producing switching and indicating signals. Input stage 21 comprises an impedance converter connected to the piezoelectrical transducer element 3 shown in FIGS. 1 and 2, which impedance converter may be fitted with a fieldeffect transistor.

Input stage 21 is followed by a narrow band amplifier 22 comprising, by way of example, two stages and tuned to a relatively narrow range of frequencies in order to preclude spurious frequencies. Said narrow range includes one of the natural frequencies of the mechanical vibratory system comprising tongue 2 and transducer element 3. The amplification factor or gain of said narrow band amplifier 22 may be, by way of example, about 100. A stage 23 having controllable threshold response, e.g. a Schmitt-trigger, follows narrow band amplifier 22. The threshold value of stage 23 is controllable by a setting device 24, such as an adjustable resistor, in a range from some millivolts to some volts. A pulse circuit 25, e.g. a monoflop or oneshot, is connected to the output of threshold responsive stage 23.

An amplifier 26 comprising two output terminals is connected to the output of pulse circuit 25 and forms an output stage of electronic circuitry 21–26. One of said output terminals is connected to a switching device 27, e.g. a relay 27, and the other output terminal is connected to an indicating or counting device 28, e.g. a lamp or a light emitting diode. The switching device may be used for stopping the textile machine when a knot appears in the travelling thread.

When the sensing device shown in FIGS. 1 and 2 is going to be used, the distance d is adjusted, depending upon the cross-sectional dimension of thread F, such that the travelling knot-free thread has no contact with the edge 7 of tongue 2, however, all knots whose diameter is greater than a certain threshold value will touch tongue 2 and cause vibration of same, inducing an output signal of transducer element 3 shaped as a damped electrical vibration. The component thereof filtered out and amplified in narrow band amplifier 22 gives rise to a short trigger pulse in threshold responsive stage 23, or a series of such pulses, the first of which trips pulse circuit 25 so that the latter generates a switching pulse of definite duration, e.g. 25 milliseconds. This switching pulse is further processed in output stage 26 in order to actuate switching device 27 and/or indicating device 28.

The inventive sensing device may be used for assessing knots in weft threads on weaving machines, e.g. gripper weaving machines, such as rapier looms, gripper shuttle looms and jet looms, where high speeds occur when the weft thread is being inserted. With this application it is important that any knot in the weft thread is detected early enough for stopping the loom before the knot enters the weaving shed, or at least that the loom is stopped in a position where the knot may be found in the open shed such as to be easily removed.

Moreover, the sensing device may be used on spinning and winding machines for assessing or counting knot-like thick places or knots.

While there is shown and described a present preferred embodiment of the invention, it is to be distinctly understood that the invention is not limited thereto, but may be otherwise variously embodied and practiced within the scope of the following claims. ACCORDINGLY,

What we claim is:

1. A device for detecting knot-like thick places in travelling textile threads, comprising:

a support structure;

a mechanical vibratory system comprising:

a vibratable plate-shaped member having two opposite ends, one of which is fixed at the support structure and the other of which is free and formed with a first straight edge;

a plate-shaped piezoelectrical structure fixedly attached to one major face of said vibratable plate-shaped member and responsive to vibration thereof;

the mechanical vibratory system having a fundamental frequency below 100 Hz;

a thread guide member mounted at the support structure and formed with a second straight edge arranged substantially parallel to and in opposite relationship to said first straight edge such that a thread passage gap is formed between said first and second straight edges; and means for adjusting the width of said thread passage gap.

2. The device defined in claim 1, wherein the support structure has a recess, the adjusting means comprises a member slidably mounted in said recess of the support structure, and a set screw supported by the support structure and engaging the slidably mounted member, and the thread guide member being attached to the slidable member.

* * * * *